US010590728B2

(12) United States Patent
Zonoz et al.

(10) Patent No.: US 10,590,728 B2
(45) Date of Patent: Mar. 17, 2020

(54) ANNULAR BLOWOUT PREVENTER PACKER ASSEMBLY

(71) Applicant: Cameron International Corporation, Houston, TX (US)

(72) Inventors: Ray Zonoz, Sugarland, TX (US); Raul Araujo, Cypress, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 15/599,886

(22) Filed: May 19, 2017

(65) Prior Publication Data

US 2018/0334876 A1 Nov. 22, 2018

(51) Int. Cl.
*E21B 33/06* (2006.01)
*E21B 33/08* (2006.01)

(52) U.S. Cl.
CPC ..... *E21B 33/06* (2013.01); *E21B 33/085* (2013.01)

(58) Field of Classification Search
USPC ..... 251/1.1, 1.2, 1.3
See application file for complete search history.

(56) References Cited

U.S. PATENT DOCUMENTS 2,038,140 A 4/1936 Frederick
2,287,205 A 6/1942 Stone
2,609,836 A 9/1952 Knox
2,812,197 A 11/1957 Gibson
2,832,617 A 4/1958 Gibson
3,323,773 A 6/1967 Walker
3,486,759 A * 12/1969 Lewis ..... E21B 33/035 166/84.4
3,561,723 A * 2/1971 Cugini ..... E21B 33/064 251/1.2
3,737,139 A 6/1973 Watts
3,887,158 A * 6/1975 Polk ..... E21B 33/06 137/462
3,897,071 A 7/1975 Le
3,915,426 A 10/1975 LeRouax
3,994,472 A 11/1976 Williams
4,095,805 A * 6/1978 Allen ..... E21B 33/06 251/1.1

(Continued)

FOREIGN PATENT DOCUMENTS

WO 2011128690 A1 10/2011
WO 2013116234 A2 8/2013
WO 2015028790 A2 3/2015

OTHER PUBLICATIONS

Non final office action for the cross referenced U.S. Appl. No. 15/456,734 dated Dec. 29, 2017.

(Continued)

*Primary Examiner* — Jessica Cahill
*Assistant Examiner* — Daphne M Barry
(74) *Attorney, Agent, or Firm* — Helene Raybaud

(57) ABSTRACT

A packer assembly for an annular blowout preventer includes an annular packer and a plurality of inserts arranged circumferentially about the annular packer. The plurality of inserts are curved along an axial axis of the packer assembly and are configured to rotate radially inwardly to enable the packer assembly to move from an open position in which the packer assembly enables fluid flow through a central bore to a closed position in which the packer assembly blocks fluid flow through the central bore.

16 Claims, 10 Drawing Sheets

(56) References Cited

U.S. PATENT DOCUMENTS

| | | | | |
|---|---|---|---|---|
| 4,099,699 | A | 7/1978 | Allen | |
| 4,283,039 | A | 8/1981 | Schaepere et al. | |
| 4,310,139 | A | 1/1982 | Williams, III et al. | |
| 4,381,868 | A | 5/1983 | Croy et al. | |
| 4,458,876 | A * | 7/1984 | Schaeper | E21B 33/06 251/1.2 |
| 4,460,150 | A | 7/1984 | Turlak et al. | |
| 4,460,151 | A | 7/1984 | Williams, III et al. | |
| 4,508,311 | A | 4/1985 | Just et al. | |
| 4,541,490 | A * | 9/1985 | Bigbie | E21B 33/08 166/379 |
| 4,579,314 | A | 4/1986 | Schaeper et al. | |
| 4,602,794 | A | 7/1986 | Schaeper et al. | |
| 4,605,195 | A | 8/1986 | Burton et al. | |
| 4,858,882 | A * | 8/1989 | Beard | E21B 33/06 251/1.2 |
| 4,949,785 | A | 8/1990 | Beard et al. | |
| 5,116,017 | A | 5/1992 | Granger et al. | |
| 5,224,557 | A | 7/1993 | Yenulis et al. | |
| 5,361,832 | A | 11/1994 | Wayne | |
| 6,367,804 | B1 | 4/2002 | Watts | |
| 6,955,357 | B2 | 10/2005 | Griffin et al. | |
| 7,159,669 | B2 * | 1/2007 | Bourgoyne | E21B 21/001 166/348 |
| 7,240,727 | B2 * | 7/2007 | Williams | E21B 33/085 166/84.1 |
| 8,176,933 | B2 | 5/2012 | Huff et al. | |
| 8,215,613 | B2 * | 7/2012 | Cheung | F16K 3/03 251/212 |
| 8,555,980 | B1 * | 10/2013 | Powell | E21B 43/0122 166/363 |
| 8,727,303 | B2 | 5/2014 | Araujo et al. | |
| 9,068,433 | B2 | 6/2015 | Bushman et al. | |
| 9,580,987 | B2 * | 2/2017 | Liotta | E21B 33/06 |
| 9,765,587 | B2 | 9/2017 | Boulanger et al. | |
| 2004/0164494 | A1 | 8/2004 | Araujo | |
| 2008/0023917 | A1 | 1/2008 | Khandoker | |
| 2009/0321066 | A1 | 12/2009 | Scoggins et al. | |
| 2010/0294482 | A1 | 11/2010 | Araujo et al. | |
| 2012/0227987 | A1 | 9/2012 | Castriotta et al. | |
| 2014/0014361 | A1 * | 1/2014 | Nelson | E21B 33/06 166/373 |
| 2014/0183381 | A1 | 7/2014 | Carbaugh et al. | |
| 2014/0209316 | A1 | 7/2014 | Tindle et al. | |
| 2015/0275609 | A1 * | 10/2015 | Liotta | E21B 33/06 166/379 |
| 2016/0201422 | A1 | 7/2016 | Averill et al. | |
| 2016/0230492 | A1 | 8/2016 | Boulanger et al. | |
| 2017/0130575 | A1 | 5/2017 | Jeffrey | |
| 2017/0145770 | A1 * | 5/2017 | Hashemian | E21B 33/06 |
| 2018/0023361 | A1 | 1/2018 | Zonoz et al. | |
| 2018/0258728 | A1 | 9/2018 | Zonoz et al. | |

OTHER PUBLICATIONS

'embed'. Dictionary.com [online]. [retrieved on Sep. 12, 2018]. Retrieved from the Internet: <URL: https://www.dictionary.com/browse/embedded>.

Durometer Shore Hardness Scale. Smooth-On, Inc. [retrieved on Feb. 20, 2018]. Retrieved from the Internet: <URL: https://www.smooth-on.com/page/durometer-shore-hardness-scale/>.

* cited by examiner

ANNULAR BLOWOUT PREVENTER PACKER ASSEMBLY

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

An annular blowout preventer (BOP) is installed on a wellhead to seal and control an oil and gas well during drilling operations. A drill string may be suspended inside an oil and gas well from a rig through the annular BOP into the well bore. During drilling operations, a drilling fluid is delivered through the drill string and returned up through an annulus between the drill string and a casing that lines the well bore. In the event of a rapid invasion of formation fluid in the annulus, commonly known as a "kick," the annular BOP may be actuated to seal the annulus and to control fluid pressure in the wellbore, thereby protecting well equipment disposed above the annular BOP. The construction of various components of the annular BOP can affect operation of the annular BOP.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments are generally directed to annular blowout preventers (BOPs). Annular BOPs may include a packer assembly (e.g., an annular packer assembly) disposed within a housing (e.g., an annular housing). A piston (e.g., annular piston) may be adjusted in a first direction to drive the packer assembly from an open position to a closed position to seal an annulus around a tubular member disposed through a central bore of the annular BOP or to close the central bore. In certain disclosed embodiments, the packer assembly includes a packer (e.g., annular packer) and inserts (e.g., rigid inserts) coupled to the packer. The inserts may be arranged in a configuration that facilitates an "iris-style closing" similar to that of an iris shutter of a camera. In certain embodiments, the packer assembly may include a collapsible ring insert (e.g., annular insert) positioned proximate to a bottom axially-facing surface of the packer. As discussed in more detail below, the disclosed embodiments may facilitate stripping operations (e.g., operations in which a drill string moves through the central bore while the annular BOP is in the closed position or a partially closed position) and/or may reduce extrusion of the packer as the annular BOP moves from the open position to the closed position, thereby reducing wear on components of the annular BOP, for example.

Figure 1:
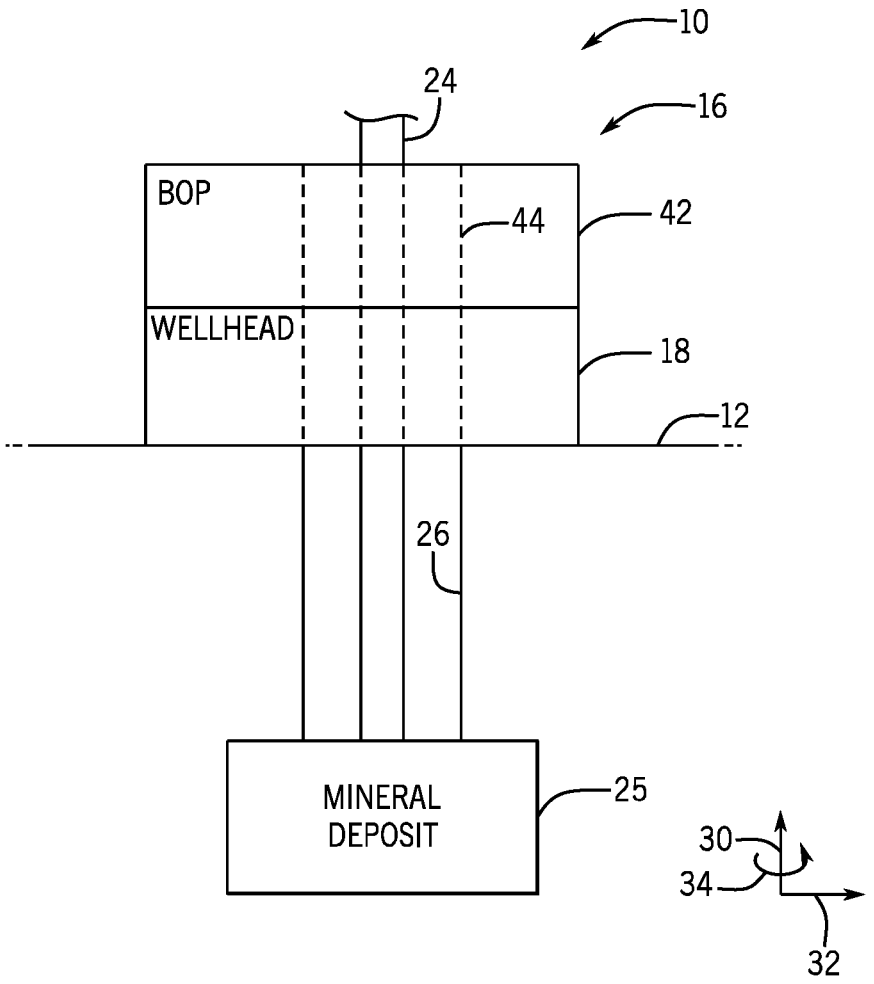
FIG. 1 is a block diagram of a mineral extraction system, in accordance with an embodiment of the present disclosure.

With the foregoing in mind, FIG. 1 is a block diagram of an embodiment of mineral extraction system 10. The illustrated mineral extraction system 10 may be configured to extract various minerals and natural resources, including hydrocarbons (e.g., oil and/or natural gas), from the earth, or to inject substances into the earth. The mineral extraction system 10 may be a land-based system (e.g., a surface system) or an offshore system (e.g., an offshore platform system). As shown, a BOP assembly 16 (e.g., BOP stack) is mounted to a wellhead 18, which is coupled to a mineral deposit via a wellbore 26. The wellhead 18 may include any of a variety of other components such as a spool, a hanger, and a "Christmas" tree. The wellhead 18 may return drilling fluid or mud to the surface 12 during drilling operations, for example. Downhole operations are carried out by a tubular string 24 (e.g., drill string, production tubing string, or the like) that extends, through the BOP assembly 16, through the wellhead 18, and into the wellbore 26.

To facilitate discussion, the BOP assembly 16 and its components may be described with reference to an axial axis or direction 30, a radial axis or direction 32, and a circumferential axis or direction 34. The BOP assembly 16 may include one or more annular BOPs 42 and/or one or more ram BOPs (e.g., shear ram, blind ram, blind shear ram, pipe ram, etc.). A central bore 44 (e.g., flow bore) extends through the one or more annular BOPs 42. As discussed in more detail below, each of the annular BOPs 42 includes a packer assembly (e.g., annular packer assembly) that is configured to be mechanically squeezed radially inwardly to seal about the tubular string 24 extending through the central bore 44 (e.g., to block an annulus about the tubular string 24) and/or to block flow through the central bore 44. The disclosed embodiments include annular BOPs 42 with a packer assembly having various features, such as inserts coupled to a packer in a configuration that facilitates "iris-style closing" and/or a collapsible ring insert that supports the packer.

Figure 2:
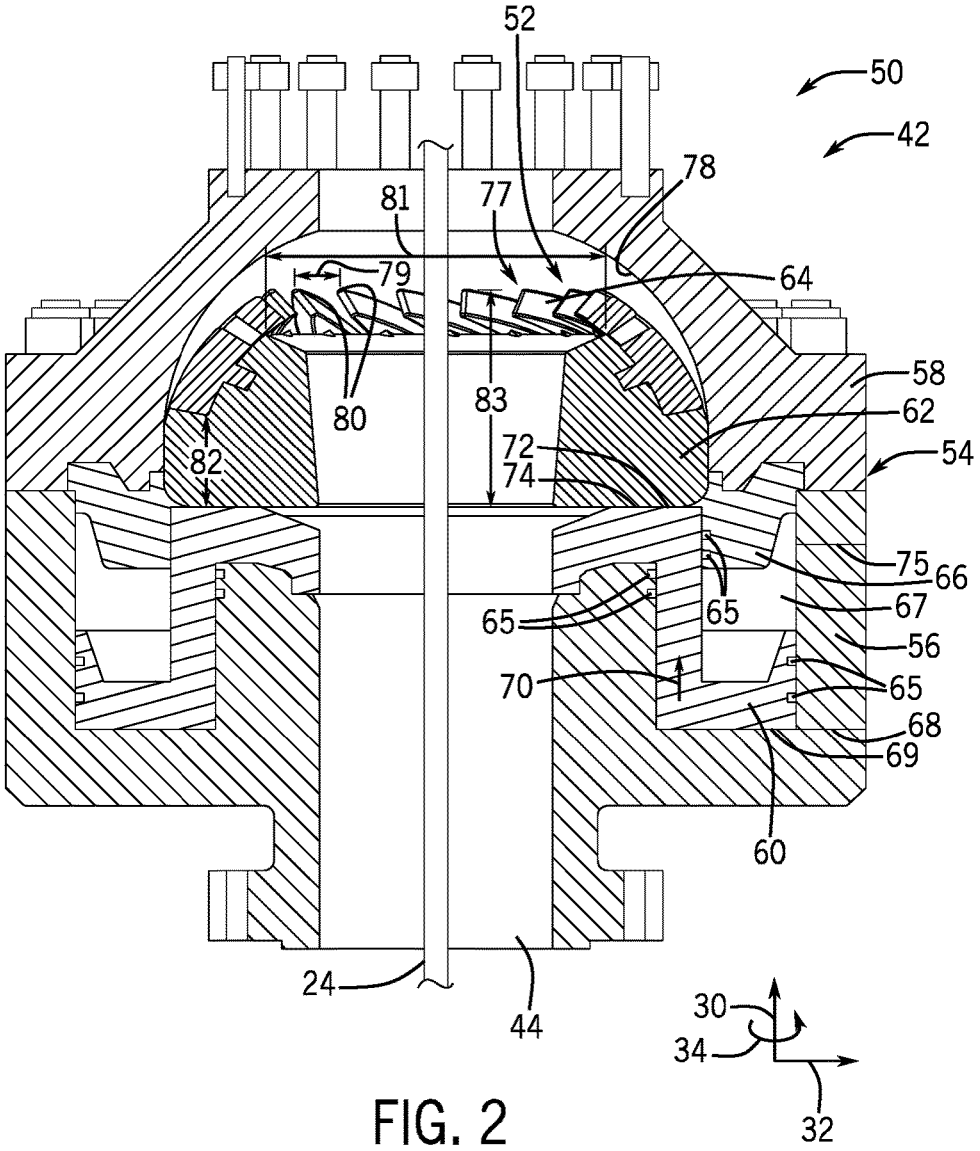
FIG. 2 is a cross-sectional side view of an embodiment of a packer assembly within an annular BOP that may be used in the system of FIG. 1, wherein the annular BOP is in an open position.

FIG. 2 is a cross-sectional side view of the annular BOP 42 that may be used in the system 10 of FIG. 1. In the illustrated embodiment, the annular BOP 42 and the components therein are in an open position 50. In the open position 50, fluid may flow through the central bore 44 of the annular BOP 42. The annular BOP 42 includes a housing 54 (e.g., annular housing) having a body 56 and a top 58 (e.g., top portion or top component) coupled to the body 56. A piston 60 (e.g., annular piston) and a packer assembly 52 (e.g., annular packer assembly) are positioned within the housing 54. The packer assembly 52 includes a packer 62 (e.g., an annular packer) and multiple inserts 64 (e.g., supporting or reinforcing inserts) positioned circumferentially about the packer 62. In certain embodiments, the packer 62 is a flexible component (e.g., elastomer) and the inserts 64 are rigid (e.g., metal or metal alloy). An adapter 66 (e.g., annular adapter) is positioned between the body 56 and the top 58. Various seals 65 (e.g., annular seals) may be provided in the body 56, the piston 60, and/or the adapter 66 to seal chambers 67, 69 (e.g., annular chambers) from the central bore 44 and from one another.

As discussed in more detail below, the piston 60 is configured to move relative to the housing 54 in the axial direction 30. For example, a fluid (e.g., a liquid and/or gas) may be provided to the gap 69 via a first fluid conduit 68 to drive the piston 60 upwardly in the axial direction 30, as shown by arrow 70. As the piston 60 moves upwardly, the piston 60 drives the packer 62 upwardly. For example, an axially-facing surface 72 (e.g., e.g., packer-contacting surface, top surface, upper surface, or annular surface) of the piston 60 may apply an upwardly force against an axially-facing surface 74 (e.g., piston-contacting surface, bottom surface, lower surface, or annular surface) of the packer 62, driving the packer upwardly. When driven upwardly by the piston 60, the packer 62 may move upwardly and inwardly within the top 58 to a closed position in which the packer 62 seals around the tubular string 24 extending through the central bore 44 and/or blocks fluid through the central bore 44. In some embodiments, a second fluid conduit 75 is configured to provide a fluid (e.g., a liquid and/or gas) to the gap 67 to drive the piston 60 downwardly, thereby causing the packer 62 to move into the open position 50.

In the illustrated embodiment, the packer assembly 52 includes the packer 62 and the multiple inserts 64. The multiple inserts 64 may support the packer 62 and may facilitate an "iris-style closing" to enable the packer assembly 62 to move upwardly and inwardly within the top 58 to adjust the annular BOP 42 from the open position 50 the closed position. As shown, the multiple inserts 64 are coupled to the packer 62, are positioned circumferentially about the packer 62 (e.g., at discrete locations circumferentially about the packer 62), contact a radially-inner surface 78 (e.g., curved annular surface) of the top 58, and are in an expanded position 77 while the annular BOP 42 is in the open position 50. In the expanded position 77, respective end portions 80 (e.g., radially-inner and/or upper end portions or tips) of adjacent inserts 64 are separated by a first distance 79 (e.g., along the circumferential axis 34), and opposed respective end portions 80 of opposed inserts 64 (e.g., diametrically opposed on opposite sides of the central bore 44) define a first diameter 81 (e.g., along the radial axis 32). In certain embodiments, the distance between respective end portions 80 of adjacent inserts 64 and the distance between respective end portions 80 of opposed inserts 64 may decrease as the annular BOP 42 moves from the open position 50 to the closed position.

In the illustrated embodiment, the multiple inserts 64 do not directly contact the piston 60 while the annular BOP 42 is in the open position 50. For example, the packer 62 is positioned between the multiple inserts 64 and the piston 60 along the axial axis 30, and the multiple inserts 64 are separated from the axially-facing surface 74 of the packer 62 and/or the axially-facing surface 72 of the piston 60 by an axial distance 82. While the annular BOP 42 is in the open position 50, the axial distance 82 may be equal to or greater than approximately 10, 20, 30, 40, or 50 percent of a total height 83 (e.g., along the axial axis) of the packer assembly 52. In certain embodiments, the multiple inserts 64 do not directly contact the piston 60 while the annular BOP 42 is in the open position 50, the closed position, or any position therebetween. However, in some embodiments, the multiple inserts 156 and the piston 60 may contact one another while the annular BOP 42 is in the open position 50, the closed position, and/or a position therebetween.

Figure 3:
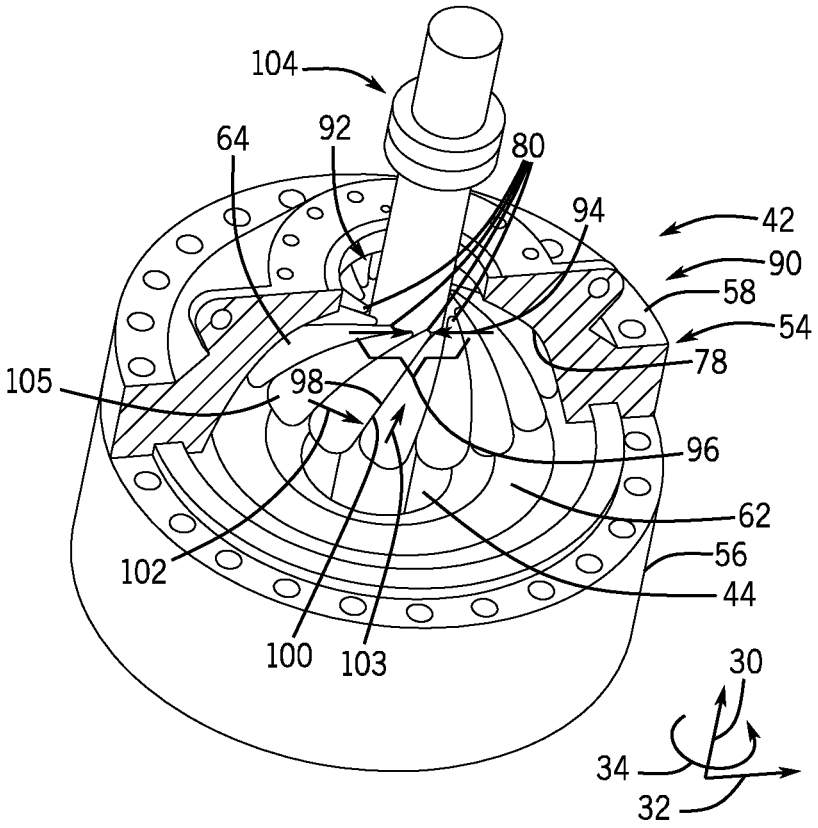
FIG. 3 is a perspective partially cut-away view of an embodiment of the packer assembly within a portion of a housing of the annular BOP of FIG. 2, wherein the annular BOP is in a closed position.

FIG. 3 is a perspective partially cut-away view of an embodiment of the annular BOP 42. For clarity, the packer 62 is transparent to illustrate the tubular member 24 and the central bore 44. In the illustrated embodiment, the annular BOP 42 and the components therein are in a closed position 90 in which the packer 62 seals about the tubular member 24 and/or blocks fluid flow through the central bore 44. As shown, in the closed position 90, the multiple inserts 64 are in a compressed position 92 in which respective end portions 80 of adjacent inserts 64 are separated by a second distance 94 (e.g., along the circumferential axis 34) that is less than the first distance 79 discussed above with respect to FIG. 2, and in which opposed respective end portions 80 of opposed inserts 64 define a second diameter 96 that is less than the first diameter 81 discussed above with respect to FIG. 2.

In operation, to move the annular BOP 42 from the open position 50 to the closed position 90, the piston 60 drives the packer assembly 52 upwardly, and the packer 62 is compressed between the top 58 and the piston 60 and the multiple inserts 64 rotate radially-inwardly (e.g., move along a spiral or parabolic path toward the center of the bore 44) in a manner similar to that of an iris shutter of a camera. As the piston 60 drives the packer assembly 52 upwardly within the housing 54, a radially-outer surface 105 (e.g., curved annular surface) of each insert 64 may slide along the radially-inner surface 78 of the top 58, and each insert 64 may be directed radially-inwardly due to the curvature of the radially-inner surface 78 of the top 58. As the packer assembly 52 moves upwardly within the top 58, a first surface 98 (e.g., side surface) of one insert 64 may move toward a second surface 100 (e.g., side surface) of an adjacent insert 64, as shown by arrow 102 (e.g., the first distance 79 between respective end portions 80 of adjacent inserts 64 decreases), and/or the first surface 98 may slide along the second surface 100, as shown by arrow 103, to enable the annular BOP 42 to move from the open position 50 to the closed position 90. In the illustrated embodiment, the multiple inserts 64 do not directly contact the piston 60 while the annular BOP 42 is in the closed position 90. For example, the packer 62 is positioned between the multiple inserts 64 and the piston 60 along the axial axis 30.

The configuration of the multiple inserts 64 may reduce extrusion of the flexible material of the packer 62 as the packer assembly 52 moves from the open position 50 to the closed position 90, for example. The configuration of the multiple inserts 64 may also facilitate stripping operations in which the tubular member 24 moves axially through the central bore 44 of the annular BOP 42, while the annular BOP 42 is in the closed position 90 or a partially closed position. For example, the tubular member 24 may include joints 104 (e.g., radially-expanded portions or connections between pipe sections that form the tubular member 24). As the joints 104 move through the central bore 44 of the annular BOP 42 during the stripping operation, the joints 104 may contact and exert a force on the respective end portions 80 of the multiple inserts 64. However, because the multiple inserts 64 are separated from the piston 60 by the packer 62 (i.e., a flexible or elastomeric component), the packer 62 may dampen the force, such that a relatively low percentage of the force is transferred to the piston 60 (e.g., as compared to some typical annular BOPs 42). Additionally or alternatively, the multiple inserts 64 may rotate radially-outwardly and/or slide relative to one another to accommodate the joint 104, thereby reducing the force transferred to the piston 60 and/or reducing wear on various components of the annular BOP 42 and/or the tubular member 24, for example.

Figure 4:
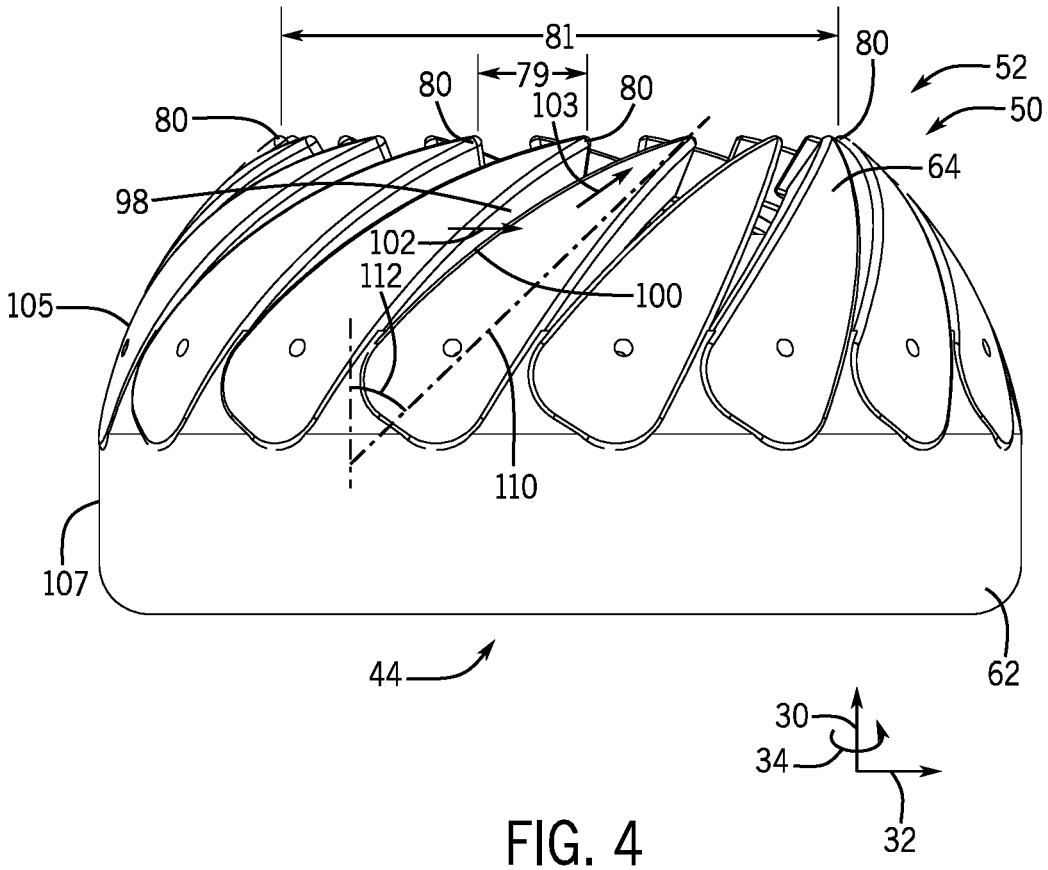
FIG. 4 is a side view of the packer assembly of FIG. 2.
Figure 5:
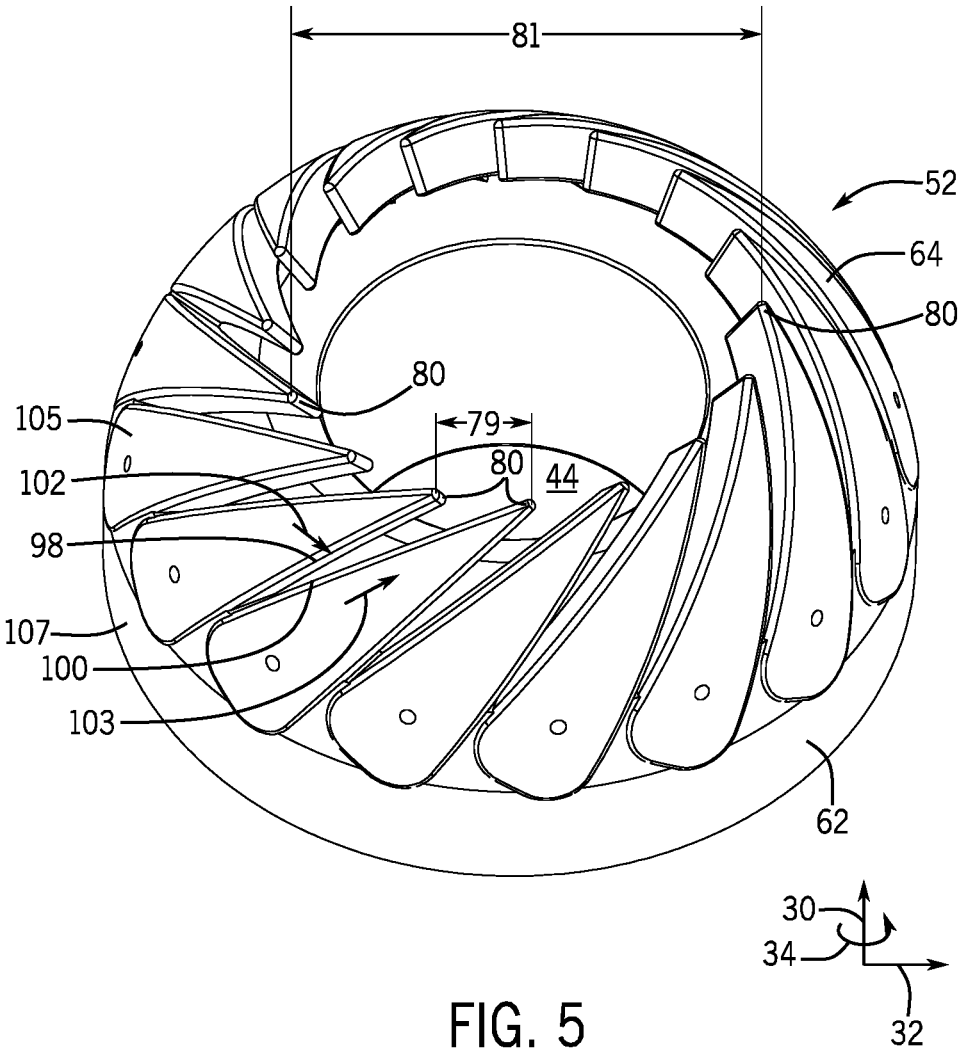
FIG. 5 is a perspective top view of the packer assembly of FIG. 2.
Figure 6:
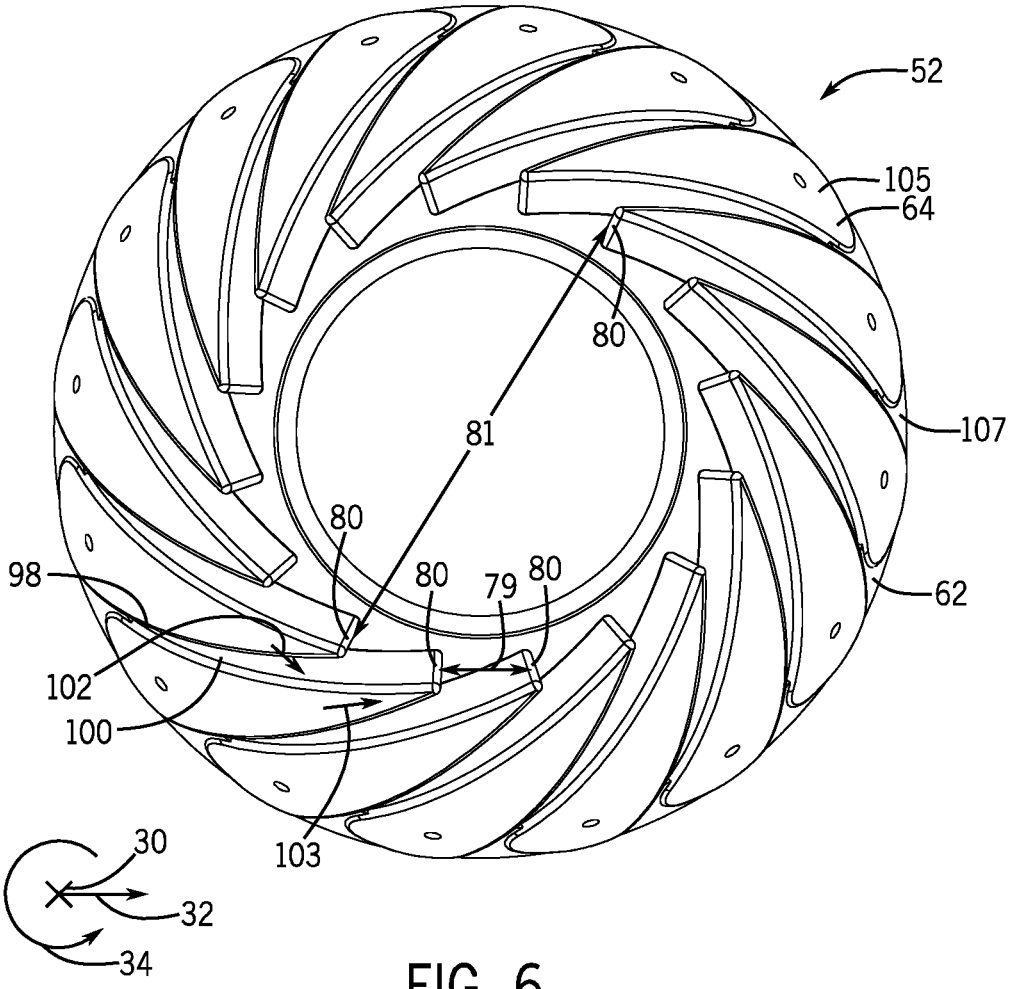
FIG. 6 is a top view of the packer assembly of FIG. 2.

FIG. 4 is a side view of an embodiment of the packer assembly 52 in the open position 50, FIG. 5 is a perspective top view of an embodiment of the packer assembly 52 in the open position 50, and FIG. 6 is a top view of the packer assembly 52 in the open position 50. As shown, the multiple inserts 64 are positioned circumferentially about the packer 62. Each insert includes the radially-outer surface 105, which curves radially-inwardly along the axial axis 30. In the illustrated, the respective radially-outer surface 105 of each insert 64 is flush (e.g., do not extend radially-outwardly from) with a radially-outer surface 107 (e.g., annular surface or top-contacting surface) of the packer 62 while the annular BOP 42 is in the open position 50, and the radially-outer surface 105 curves radially-inwardly along the axial axis 30, such that the respective end portion 80 of each insert 64 is located radially-inwardly from the radially-outer surface 107 of the packer 62.

Each insert 64 is oriented at an angle relative to the axial axis 30 and relative to the central bore 44 of the packer assembly 52, while the packer assembly 52 is in the open position 50. For example, as shown in FIG. 4, a central axis 110 (e.g., longitudinal axis) of each insert 64 is positioned at an angle 112 (e.g., non-parallel) relative to the axial axis 30 and relative to the central bore 44 of the packer assembly 52. In certain embodiments, the angle 112 may change (e.g., increase) as the packer assembly 52 moves from the open position 50 to the closed position 90.

In the open position 50, respective end portions 80 of adjacent inserts 64 are separated by the first distance 79, and opposed respective end portions 80 of opposed inserts 64 are separated by the first diameter 81. As noted above, the distance and the diameter decrease as the packer assembly 52 moves from the open position 50 to the closed position 90. As noted above, the multiple inserts 64 move in an "iris-style closing" manner in which each insert 64 rotates radially-inwardly along a generally a spiral or parabolic path as the packer assembly 52 moves from the open position 50 to the closed position 90. For example, the first surface 98 of one insert 64 may move toward and/or slide along the second surface 100 of the adjacent insert 64, as shown by arrows 102 and 103, as the packer assembly 52 moves from the open position 50 to the closed position 90.

Figure 7:
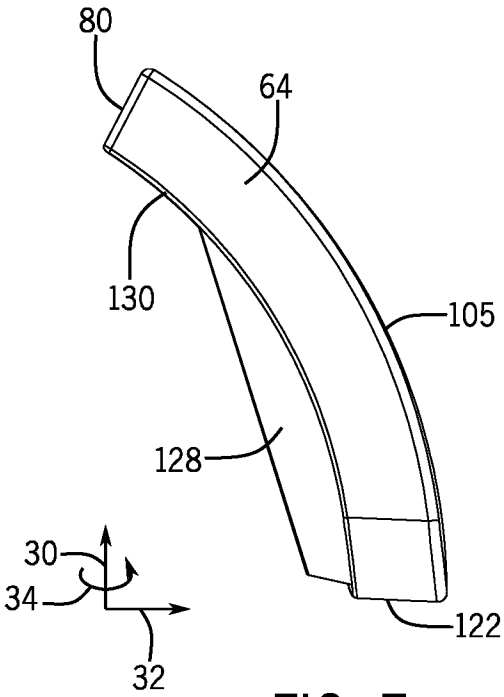
FIG. 7 is a side view of an embodiment of an insert that may be used in the packer assembly of FIG. 2.
Figure 8:
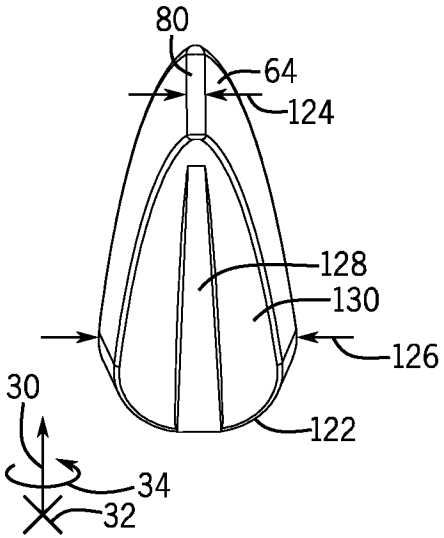
FIG. 8 is a front view of the insert of FIG. 7.
Figure 9:
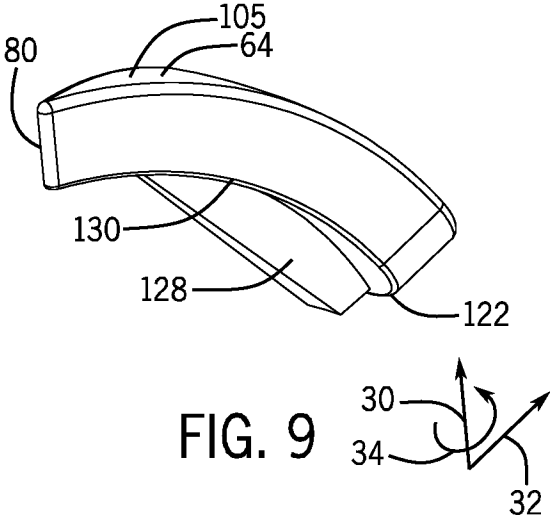
FIG. 9 is a perspective view of the insert of FIG. 7.

FIG. 7 is a side view of an embodiment of one insert 64 that may be used in the packer assembly 52, FIG. 8 is a front view of one insert 64 that may be used in the packer assembly 52, and FIG. 9 is a perspective view of one insert 64 that may be used in the packer assembly 52. As shown, the insert 64 includes the radially-outer surface 105 that curves and extends between the end portion 80 and another end portion 122. The curved radially-outer surface 105 may have a curvature that generally corresponds to the curvature of the radially-inner surface 78 of the top 58, as shown in FIGS. 2 and 3, for example. As shown, a width (e.g., along the circumferential axis 30) may vary between the end portion 80 and the another end portion 122. For example, in the illustrated embodiment, a first width 124 proximate to the end portion 80 is less than a second width 126 proximate to the another end portion 122. In the illustrated embodiment, the insert 64 includes a protrusion 128 (e.g., ridge, extension, packer-engaging protrusion) that extends radially-inwardly from a radially-inner surface 30 (e.g., curved surface) of the insert 64. As discussed in more detail below, the protrusion 128 may engage a corresponding recess of the packer 62, thereby securing the insert 64 to the packer 68.

Figure 10:
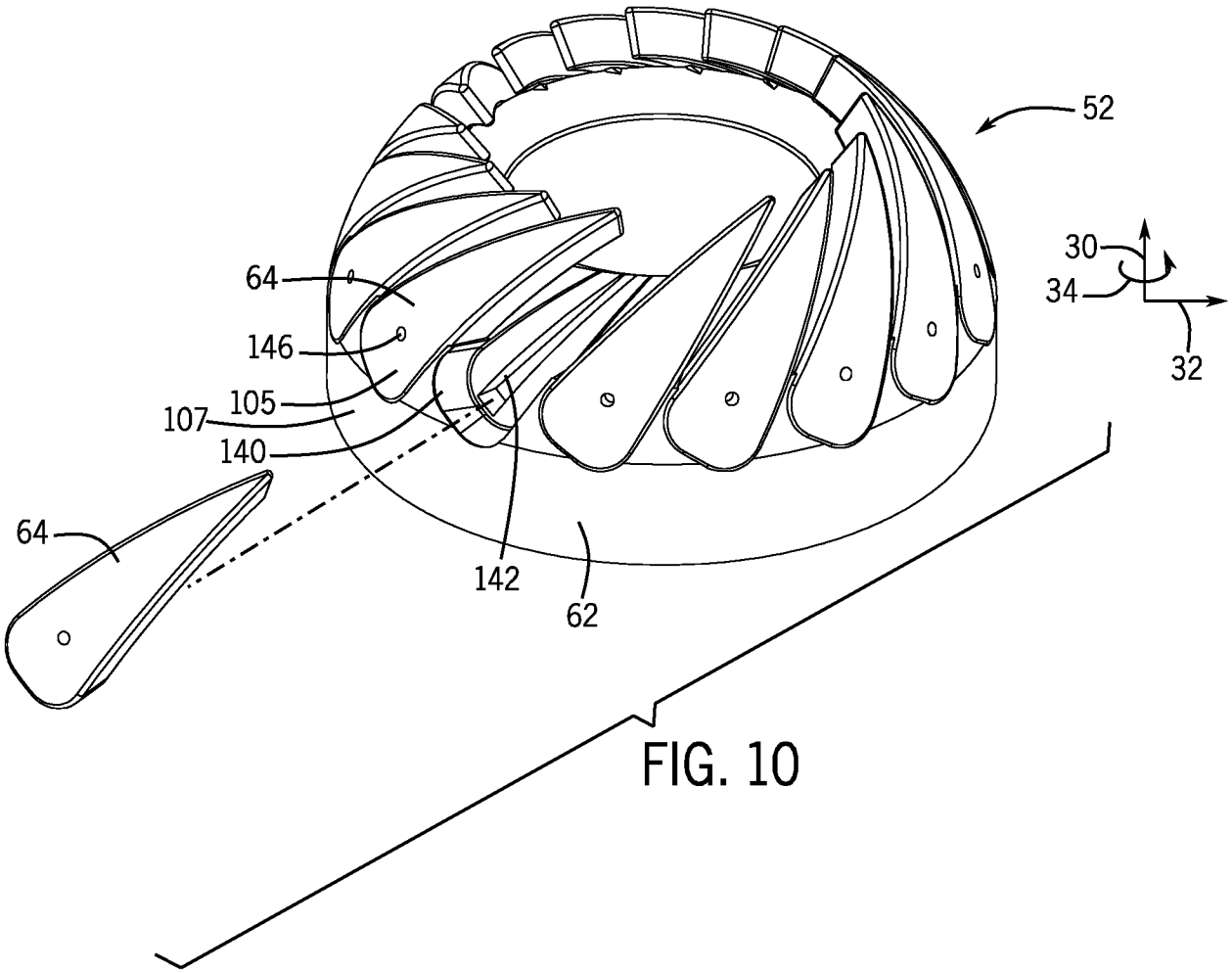
FIG. 10 is a perspective view of the packer assembly of FIG. 2 with one insert removed.

FIG. 10 is a perspective view of the packer assembly 52 with one insert 64 removed and showing a recess 140 (e.g., cavity or seat) and a groove 142 formed in the packer 62. In some embodiments, the recess 140 has a shape that generally corresponds to the insert 64 and the groove 142 has a shape that generally corresponds to the protrusion 128 extending from the radially-inner surface 30 of the insert 64. In this manner, the multiple inserts 64 may be coupled to and may move with the packer 62 within the housing 54 of the annular BOP 42. The packer assembly 52 may be manufactured via any suitable technique, although in certain embodiments, the inserts 64 may be secured to a mold housing (e.g., via respective fasteners, which may be received by threaded openings 146), and the material that forms the packer 62 may then be deposited into the mold housing about the inserts 64, thereby forming the packer 62 having the recess 140 and the grooves 142 and coupling the packer 62 to the inserts 64.

Figure 11:
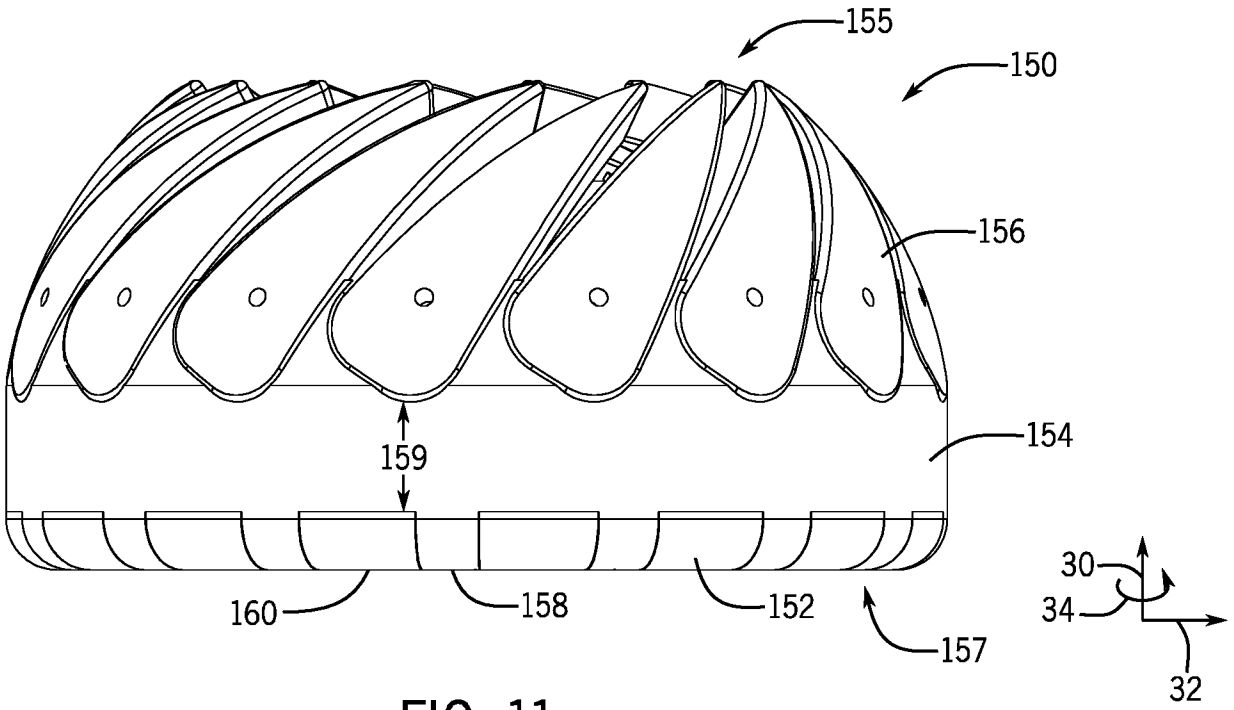
FIG. 11 is a side view of an embodiment of a packer assembly having a collapsible ring insert.

FIG. 11 is a side view of an embodiment of a packer assembly 150 (e.g., annular packer assembly) having a collapsible ring insert 152 (e.g., annular insert) that may be utilized within the annular BOP 42 of FIG. 2. The packer assembly 150 may include a packer 154 (e.g., annular packer) and multiple inserts 156. It should be appreciated that the packer 154 may include any of the features of the packer 60 discussed above with respect to FIGS. 2-10, and may also be configured to receive and/or couple to the collapsible ring insert 152. Similarly, the multiple inserts 156 may include any of the features of the multiple inserts 64 discussed above with respect to FIGS. 2-10.

As shown, the multiple inserts 156 are positioned circumferentially about a first axial end 155 (e.g., upper or top end portion) of the packer 62, and the collapsible ring insert 152 extends circumferentially about a second axial end 157 (e.g., lower or bottom end portion) of the packer 62. In the illustrated embodiment, the packer 62 is positioned between the multiple inserts 156 and the collapsible ring insert 152 along the axial axis 30, and the multiple inserts 156 are separated from the collapsible ring insert 152 by an axial distance 159. Thus, the multiple inserts 156 and the collapsible ring insert 152 do not contact one another while the annular BOP 42 is in the open position 50, and may not contact one another while the annular BOP 42 is in the closed position or any position therebetween. However, in some embodiments, the multiple inserts 156 and the collapsible ring insert 152 may contact one another while the annular BOP 42 is in the open position 50, the closed position, and/or a position therebetween.

It should be appreciated that the piston 60 may contact an axially-facing surface 158 of the packer 154 and/or an axially-facing surface 160 of the collapsible ring insert 152 as the piston 60 drives the packer assembly 150 within the housing 54 of the annular BOP of FIG. 2. The collapsible ring insert 152 may support the packer 154 and/or reduce extrusion of the packer 154 as the annular BOP 42 moves from the open position 50 to the closed position 90, for example.

Figure 12:
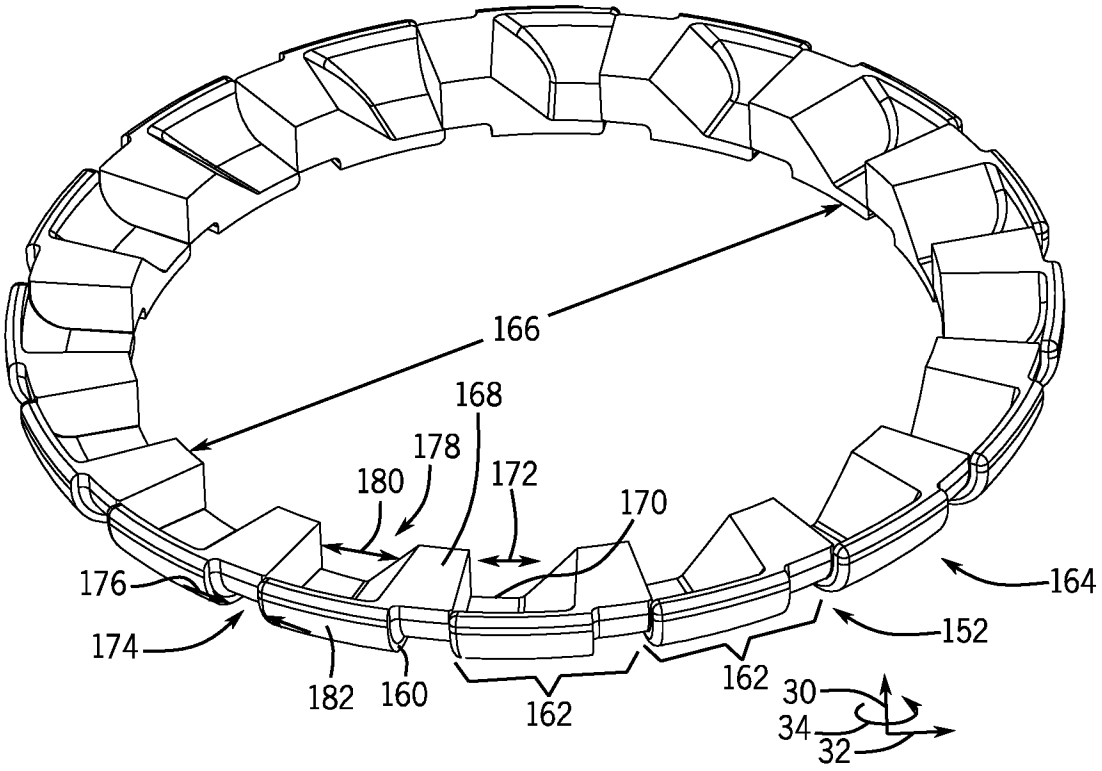
FIG. 12 is a perspective view of the collapsible ring insert of FIG. 11.

With the foregoing in mind, FIG. 12 is a perspective view of the collapsible ring insert 152 of FIG. 11. As shown, the collapsible ring insert 152 includes multiple segments 162 arranged into a ring or annular structure, and the multiple segments 162 are configured to move relative to one another to enable the collapsible ring insert 152 to move from the illustrated expanded position 164 to a collapsed position as the annular BOP 42 moves from the open position 50 to the closed position 90. An inner diameter 166 defined by the collapsible ring insert 152 may decrease as the collapsible ring insert 152 transitions from the expanded position 164 to the collapsed position.

Each segment 162 of the collapsible ring insert 152 may include a key portion 168 (e.g., first portion or radially-inner portion) and a slot portion 170 (e.g., second portion, radially-outer portion, or seat portion). Each key portion 168 may be received by a respective slot portion 170 of an adjacent segment 162, as shown by arrows 172, thereby moving respective key portions 168 of adjacent segments 162 toward one another, moving respective slot portions 170 of adjacent segments 162 toward one another, and enabling transition from the expanded position 164 to the collapsed position.

As shown, the respective slot portions 170 of adjacent segments 162 are separated from one another by a gap 174 (e.g., circumferential gap) while the collapsible ring insert 152 is in the expanded position 164, and a circumferential distance 176 across the gap 174 may decrease as the collapsible ring insert 152 moves from the expanded position 164 to the collapsed position. Similarly, the respective key portions 168 of adjacent segments 162 are separated from one another by a gap 178 (e.g., circumferential gap) while the collapsible ring insert 152 is in the expanded position 164, and a circumferential distance 180 across the gap 178 decreases as the collapsible ring insert 152 moves from the expanded position 164 to the collapsed position.

As shown in FIG. 11, the packer 62 may be positioned within or fill the gap 174. In certain embodiments, the packer 62 may be positioned within or fill the gap 178. Thus, the packer 62 within the gap 174 and/or the gap 178 may be compressed as the collapsible ring insert 152 moves from the expanded position 164 to the collapsed position, the packer 62 may limit the movement of the collapsible ring insert 152 toward the collapsed position, and/or the packer 62 may bias the collapsible ring insert 152 toward the expanded position 164. As noted above, the packer assembly 150 may be manufactured via any suitable technique. For example, in certain embodiments, the collapsible ring insert 152 and the multiple inserts 156 may be secured to a mold housing (e.g., via respective threaded fasteners), and the material that forms the packer 154 may then be deposited into the mold housing about the collapsible ring insert 152 and the multiple inserts 156. Accordingly, in some embodiments, the packer 154 may entirely surround the collapsible ring insert 152 or may surround a portion of the collapsible ring insert 152, while leaving the axially-facing surface 160 and/or a radially-outer surface 182 of the respective slot portions 170 exposed, uncovered, or visible (e.g., only the axially-facing surface 160 and/or the radially-outer surface 182 of the respective slot portions 170 are exposed, uncovered, or visible).

Any of the features disclosed above may be combined or used together in any of a variety of manners. For example, the collapsible ring insert 152 illustrated in FIGS. 11 and 12 may be utilized in combination with any of the features described or illustrated with respect to FIGS. 1-10.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is intended to cover all modifications, equivalents, and alternatives falling within the spirit and scope of the disclosure as defined by the following appended claims.

The invention claimed is:

1. A packer assembly for an annular blowout preventer, comprising:

an annular packer disposed about a central axial axis; and a plurality of inserts arranged circumferentially about a first axial end portion of the annular packer, wherein each of the plurality of inserts is coupled to the annular packer via a mounting interface extending along a first central axis, the first central axis does not intersect the central axial axis of the annular packer, the plurality of inserts are curved along the central axial axis of the packer assembly and are configured to rotate about the central axial axis as the plurality of inserts are directed radially inwardly to enable the packer assembly to move from an open position in which the packer assembly enables fluid flow through a central bore to a closed position in which the packer assembly blocks fluid flow through the central bore; and an annular collapsible ring insert formed from a rigid material and extending circumferentially about the annular packer proximate to a second axial end portion of the annular packer, wherein the annular collapsible ring insert is separate from the plurality of inserts and comprises multiple segments arranged to form an annular structure, and the multiple segments are configured to move in a circumferential direction relative to one another to enable the annular collapsible ring insert to transition from an expanded position to a collapsed position;

wherein the collapsible ring insert is configured to transition from the expanded position to the collapsed position as the packer assembly moves from the open position to the closed position.

2. The packer assembly of claim 1, wherein the annular packer comprises a flexible material and the plurality of inserts comprise a rigid material.

3. The packer assembly of claim 1, wherein the plurality of inserts comprise a first insert and a second insert adjacent to the first insert, wherein the first insert is configured to move toward the second insert and to slide along the second insert as the plurality of inserts rotate radially inwardly.

4. The packer assembly of claim 1, wherein the plurality of inserts are configured to rotate about the central axial axis as the plurality of inserts are directed radially outwardly as a joint of a tubular member extending through the central bore of the packer assembly contacts the plurality of inserts.

5. The packer assembly of claim 1, wherein each of the plurality of inserts comprise a respective second central axis, and the second central axis is non-parallel to the central axial axis of the packer assembly and includes a component extending along a circumferential axis of the packer assembly while the packer assembly is in the open position and while the packer assembly is in the closed position.

6. The packer assembly of claim 1, wherein each of the plurality of inserts are supported within a corresponding recess formed in the annular packer, and the mounting interface comprises the recess extending along the first central axis not intersecting the central axial axis of the annular packer.

7. The packer assembly of claim 1, wherein each of the plurality of inserts comprises a radially-inner surface and a protrusion that extends radially-inwardly from the radially-inner surface, and the mounting interface comprises the protrusion extending along the first central axis not intersecting the central axial axis of the annular packer.

8. The packer assembly of claim 1, wherein the plurality of inserts are separated from a bottom axially-facing annular surface of the annular packer by an axial gap.

9. The packer assembly of claim 1, wherein the plurality of inserts are configured to contact a curved radially-inner surface of a housing of the annular BOP when the packer assembly is installed within the annular BOP.

10. An annular blowout preventer, comprising:

a housing;

an annular piston positioned within the housing; and a packer assembly positioned within the housing, wherein the packer assembly comprises:

an annular packer;

a plurality of inserts arranged circumferentially about a first axial end portion of the annular packer; and an annular collapsible ring insert formed from a rigid material and extending circumferentially about the annular packer proximate to a second axial end portion of the annular packer, wherein the annular collapsible ring insert is separate from the plurality of inserts and comprises multiple segments arranged to form an annular structure, and the multiple segments are configured to move in a circumferential direction relative to one another to enable the annular collapsible ring insert to transition from an expanded position to a collapsed position;

wherein the annular piston is configured to contact a bottom surface of the annular packer to drive the packer assembly in an axial direction within the housing, thereby compressing the annular packer, causing the plurality of inserts to move over a range of movement including rotating radially inwardly, and moving the annular blowout preventer to a closed position, wherein the annular piston does not contact the plurality of inserts while the annular blowout preventer is in an open position, the closed position, and any position therebetween and wherein the collapsible ring insert is configured to transition from the expanded position to the collapsed position as the annular blowout preventer moves from the open position to the closed position.

11. The annular blowout preventer of claim 10, wherein each of the plurality of inserts comprises a curved radially-outer surface.

12. The annular blowout preventer of claim 10, wherein the annular packer is positioned between the plurality of inserts and the piston along an axial axis of the annular blowout preventer, thereby blocking contact between the plurality of inserts and the piston while the annular blowout preventer is in the open position, the closed position, and any position therebetween.

13. The annular blowout preventer of claim 10, wherein an interface between the annular piston and the bottom surface of the annular packer is annular, thereby enabling the annular packer to block contact between the annular piston and the plurality of inserts while the annular blowout preventer is in the open position, the closed position, and any position therebetween.

14. A system, comprising:

a packer assembly, comprising:

an annular packer;

a plurality of inserts arranged circumferentially about a first axial end portion of the annular packer; and an annular collapsible ring insert formed from a rigid material and extending circumferentially about the annular packer proximate to a second axial end portion of the annular packer, wherein the annular collapsible ring insert is separate from the plurality of inserts and comprises multiple segments arranged to form an annular structure, and the multiple segments are configured to move in a circumferential direction relative to one another to enable the annular collapsible ring insert to transition from an expanded position to a collapsed position;

wherein the plurality of inserts are configured to rotate radially inwardly as the packer assembly moves from an open position in which the packer assembly enables fluid flow through a central bore to a closed position in which the packer assembly blocks fluid flow through the central bore, and the collapsible ring insert is configured to transition from the expanded position to the collapsed position as the packer assembly moves from the open position to the closed position.

15. The system of claim 14, wherein the annular packer is positioned between the plurality of inserts and the annular collapsible ring insert along an axial axis of the packer assembly, such that none of the plurality of inserts contact the annular collapsible ring insert while the packer assembly is in the open position.

16. The system of claim 14, wherein each segment of the multiple segments comprises a key portion and a slot portion, the key portion is received within the slot portion as the annular collapsible ring insert transitions from the expanded position to the collapsed position.

* * * * *